US006923664B2

(12) United States Patent
Ito et al.

(10) Patent No.: US 6,923,664 B2
(45) Date of Patent: Aug. 2, 2005

(54) PLUG CONNECTOR FOR DIFFERENTIAL TRANSMISSION

(75) Inventors: Takeshi Ito, Shinagawa (JP); Mitsuru Kobayashi, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/822,685

(22) Filed: Apr. 13, 2004

(65) Prior Publication Data

US 2004/0242071 A1 Dec. 2, 2004

(30) Foreign Application Priority Data

May 27, 2003 (JP) ..... 2003-148692

(51) Int. Cl.[7] ..... H01R 13/648
(52) U.S. Cl. ..... 439/108; 439/608
(58) Field of Search ..... 439/108, 101, 439/608, 607, 609, 610

(56) References Cited

U.S. PATENT DOCUMENTS 6,379,188 B1 * 4/2002 Cohen et al. ..... 439/608
6,461,202 B2 * 10/2002 Kline ..... 439/701
6,503,103 B1 * 1/2003 Cohen et al. ..... 439/608
6,551,140 B2 * 4/2003 Billman et al. ..... 439/608
6,572,409 B2 * 6/2003 Nitta et al. ..... 439/608
6,602,095 B2 * 8/2003 Astbury et al. ..... 439/608
6,607,402 B2 * 8/2003 Cohen et al. ..... 439/608
6,712,646 B2 * 3/2004 Shindo ..... 439/608
6,764,349 B2 * 7/2004 Provencher et al. ..... 439/701
6,808,420 B2 * 10/2004 Whiteman et al. ..... 439/608
6,827,611 B1 * 12/2004 Payne et al. ..... 439/608
6,848,944 B2 * 2/2005 Evans ..... 439/608
6,872,085 B1 * 3/2005 Cohen et al. ..... 439/108

FOREIGN PATENT DOCUMENTS

JP 2003-059593 2/2003

* cited by examiner

*Primary Examiner*—Gary Paumen
(74) *Attorney, Agent, or Firm*—Staas & Halsey LLP

(57) ABSTRACT

A plug connector for differential transmission is disclosed. The plug connector includes ground contact members and signal contact pairs that are arranged alternately. Each signal contact pair is composed of first and second signal contact members. The mounting terminal part and a portion of the base part on the mounting terminal part side of each ground contact member are thinner than the ground contact part of the ground contact member. The mounting terminal parts of the first and second signal contact members and the mounting terminal parts of the ground contact members are positioned in the same plane so that the mounting terminal parts of the first and second signal contact members of each signal contact pair are disposed between the mounting terminal parts of the ground contact members adjacent to the signal contact pair.

7 Claims, 7 Drawing Sheets

PLUG CONNECTOR FOR DIFFERENTIAL TRANSMISSION

BACKGROUND OF THE INVENTION

1. Field of the Invention

The present invention relates generally to plug connectors for differential transmission, and more particularly to a right angle-type plug connector for differential transmission having L-shaped mounting terminals so as to be mounted on a printed circuit board with the connection part of the plug connector being parallel to the printed circuit board.

2. Description of the Related Art

Differential transmission has been employed in many cases as a method of transmitting data between personal computers and peripheral devices. Differential transmission uses a pair of lines for each data element, and simultaneously transmits a "+" signal to be transmitted and a "−" signal equal in magnitude and opposite in direction to the "+" signal so that the difference in level between the "+" and "−" signals is recognized as information. Differential transmission has the advantage of being less susceptible to noise compared with a normal transmission method.

In order for differential transmission to work properly, the paired lines, one for transmitting the "+" signal and the other for the "−" signal, should be parallel and equal in length. Further, ground potential should be provided between pairs of adjacent lines so that a shield is provided therebetween.

FIG. 1 is a diagram showing a conventional plug connector 10 for differential transmission. In FIG. 1, $X_1$–$X_2$ and $Z_1$–$Z_2$ indicate the directions of width and the directions of height, respectively, of the plug connector 10. Further, $Y_2$ indicates the direction in which the plug connector 10 is inserted to be connected (the insertion and connection direction of the plug connector 10) and $Y_1$ indicates the opposite direction. The plug connector 10 includes a block body 20, which is an electrically insulating molded component of a synthetic resin. Pairs of first and second signal contact members 30-1 and 30-2 and plate-like ground contact members 31 are incorporated into the block body 20 so as to be arranged alternately at predetermined pitches $P_1$ in the $X_1$–$X_2$ directions or along the X-axis.

Each ground contact member 31 includes a mounting terminal part 31*a* shaped like a fork. A mounting terminal part 30-1*a* of the signal contact member 30-1 and a mounting terminal part 30-2*a* of the signal contact member 30-2 extend linearly in the $Y_1$ direction and oppose each other in the $Z_1$–$Z_2$ directions or along the Z-axis.

The mounting terminal parts 31*a* and the mounting terminal parts 30-1*a* and 30-2*a* are soldered to pads on a printed board 40 while holding an edge part of the printed board 40 so that the plug connector 10 is mounted thereon.

Japanese Laid-Open Patent Application No. 2003-059593 discloses such a plug connector.

In recent years, differential transmission plug connectors have been used in a wide variety of modes. For instance, it has been required to mount a differential transmission plug connector on a printed circuit board with the insertion and connection direction of the plug connector being parallel to the surface of the printed circuit board. To this end, the plug connector should be of a right angle type with the mounting terminal parts of paired signal contact members being L-shaped, as parallel to each other as possible, and equal in length.

SUMMARY OF THE INVENTION

Accordingly, it is a general object of the present invention to provide a plug connector for differential transmission in which the above-described problems are solved.

A more specific object of the present invention is to provide a differential transmission plug connector of a right angle type mountable on a printed circuit board.

The above objects of the present invention are achieved by a plug connector for differential transmission, including: a block body made of an insulating material, the block body including a main body part and a projection part projecting therefrom; a plurality of plate-like ground contact members each including a plate-like base part, a ground contact part on a first side of the base part, and a mounting terminal part on a second side of the base part opposite to the first side, the base part and the ground contact part being fixed to the main body part and the projection part, respectively, of the block body; a plurality of first signal contact members each including a base part, a signal contact part on a first side of the base part, and a mounting terminal part on a second side of the base part opposite to the first side, the base part and the signal contact part being fixed to the main body part and the projection part, respectively, of the block body; and a plurality of second signal contact members each including a base part, a signal contact part on a first side of the base part, and a mounting terminal part on a second side of the base part opposite to the first side, the base part and the signal contact part being fixed to the main body part and the projection part, respectively, of the block body, wherein: the first signal contact members and the corresponding second signal contact members form signal contact pairs; the signal contact pairs and the ground contact members are arranged alternately, being supported by the block body; each ground contact member is shaped so that the ground contact member thereof is positioned vertically at a distance from a plane in which the mounting terminal part thereof is disposed, and a portion of the base part thereof on a mounting terminal part side and the mounting terminal part thereof each have a dimension smaller than that of the ground contact part thereof in a direction in which the ground contact members are arranged; each of the first and second signal contact members is shaped so that a length adjustment part and an extension part are provided between the base part and the mounting terminal part thereof; and the mounting terminal parts of the first and second signal contact members and the mounting terminal parts of the ground contact members are positioned in the same plane so that the mounting terminal parts of the first and second signal contact members of each signal contact pair are disposed between the mounting terminal parts of the ground contact members adjacent to the signal contact pair.

According to the above-described plug connector, in each ground contact member, a mounting terminal part-side portion of its base part and its mounting terminal part are thinner than its ground contact part. Accordingly, the space between the mounting terminal parts of the ground contact members is increased without reducing the width of each of the upper and lower ends of the ground contact part of each ground contact member and decreasing mechanical strength. As a result, the mounting terminal parts of the first and second signal contact members can be disposed in the space between the mounting terminal parts of the ground contact members adjacent to the paired first and second signal contact members. The mounting terminal parts of the first and second signal contact members and the ground contact members are arranged in the same plane. Accordingly, a differential transmission plug connector of a right angle type that can be mounted on a printed circuit board is realized.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of an embodiment of the present invention.

Figure 1:
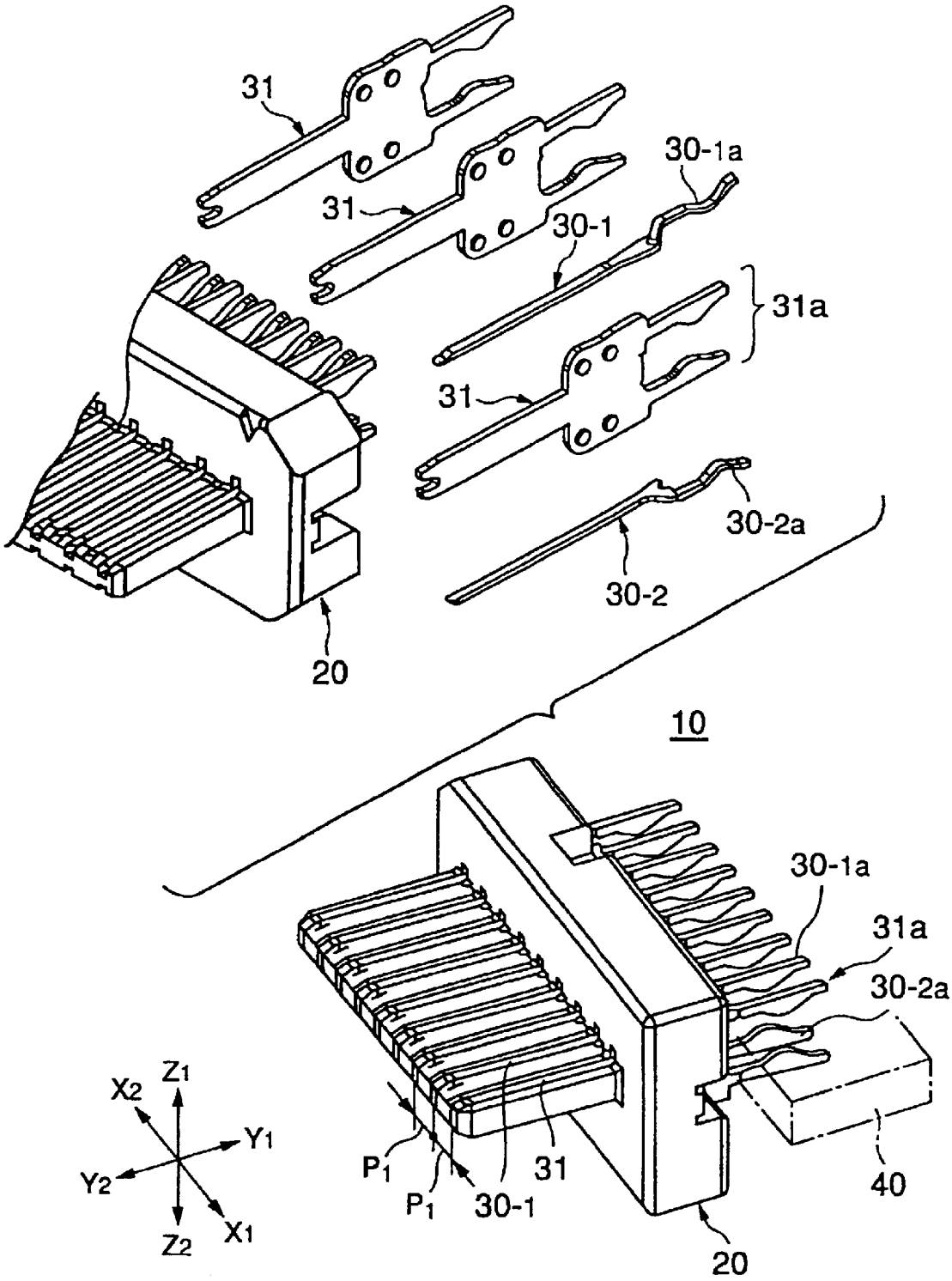
FIG.1 PRIOR ART
FIG. 1 is a diagram showing a conventional plug connector for differential transmission.
Figure 2:
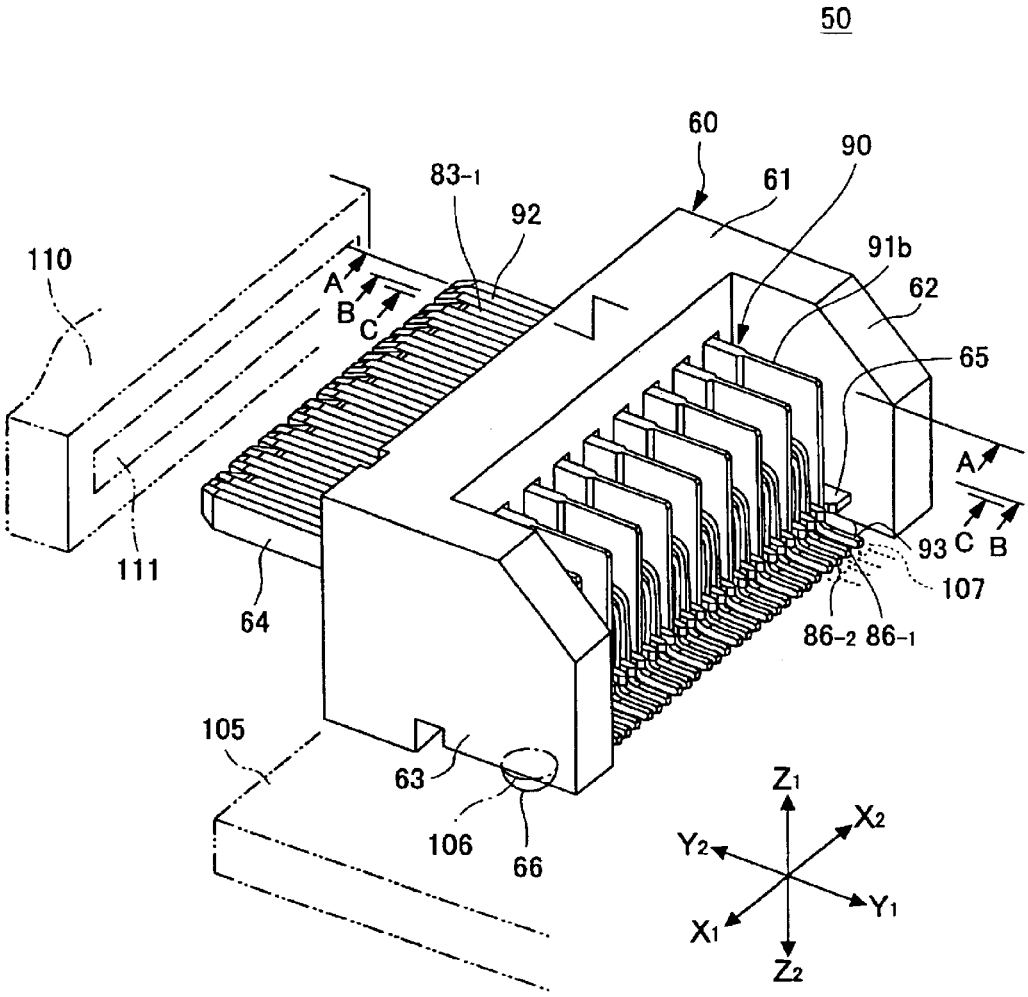
FIG. 2 is a perspective view of a differential transmission plug connector of a right angle type according to an embodiment of the present invention.
Figure 3:
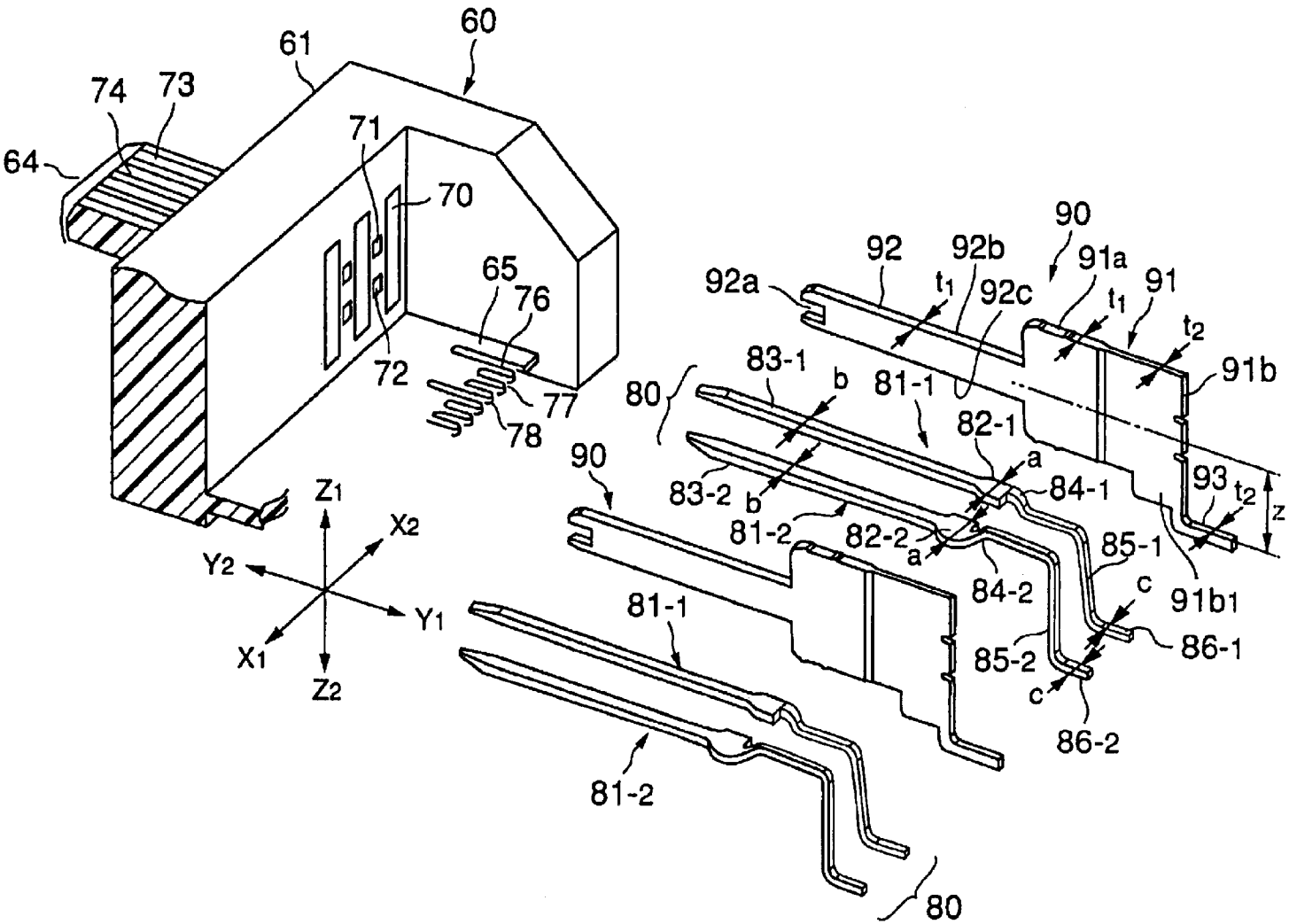
FIG. 3 is an exploded perspective view of the plug connector according to the embodiment of the present invention.
Figure 4:
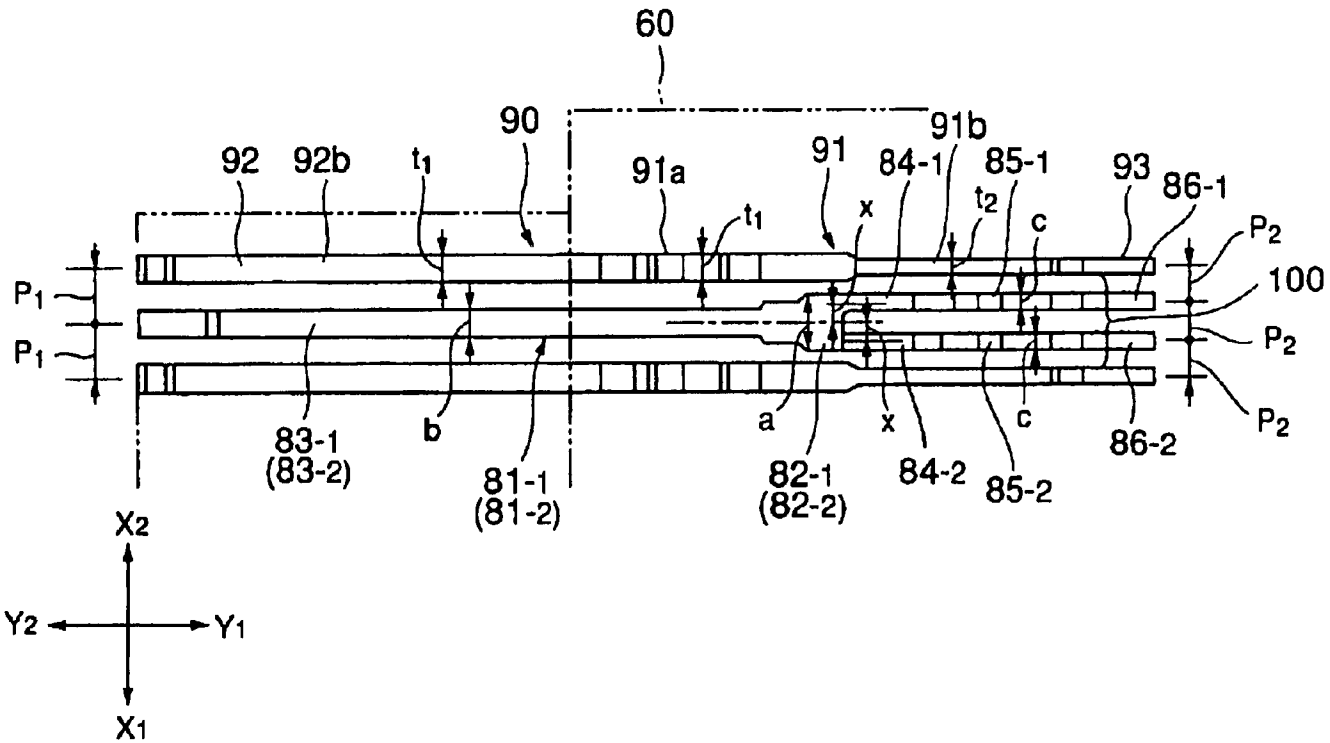
FIG. 4 is a diagram showing an arrangement of signal and ground contact members of the plug connector according to the embodiment of the present invention.

FIGS. 2 and 3 are diagrams showing a differential transmission plug connector 50 of a right-angle and surface-mounting type. In FIGS. 2 and 3, $X_1$–$X_2$ and $Z_1$–$Z_2$ indicate the directions of width and the directions of height, respectively, of the plug connector 50. Further, $Y_2$ indicates the direction in which the plug connector 50 is inserted to be connected (the insertion and connection direction of the plug connector 50), and $Y_1$ indicates the opposite direction. The plug connector 50 includes a block body 60, which is an electrically insulating molded component of a synthetic resin. Signal contact pairs 80 of first and second signal contact members 81-1 and 81-2 and plate-like ground contact members 90 are incorporated into the block body 60. Referring to FIG. 4, the first and second signal contact members 81-1 and 81-2 (signal contact pairs 80) and the ground contact members 90 are arranged alternately at the same pitch $P_1$ in the $X_1$–$X_2$ directions or along the X-axis. Each of the first and second signal contact members 81-1 and 81-2 is positioned, for its length, between the adjacent ground contact members 90.

Figure 5A:
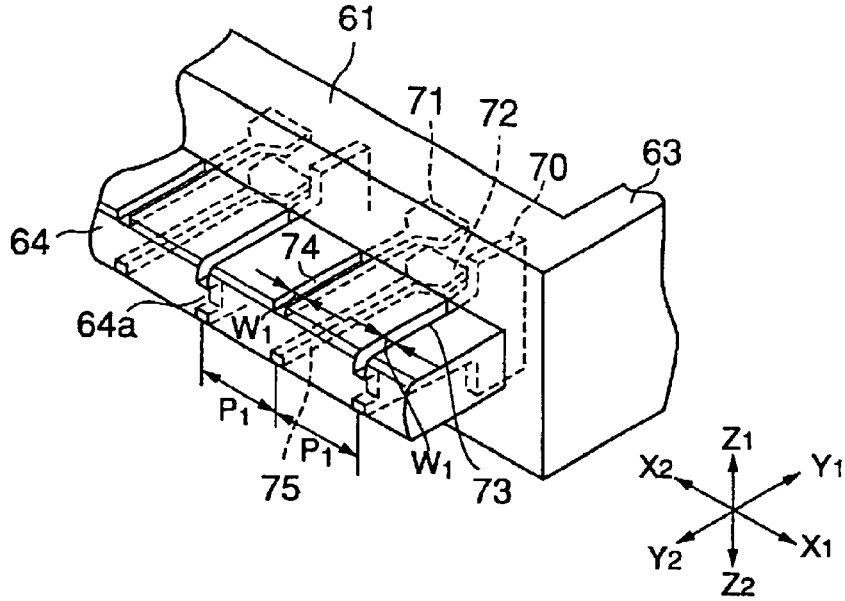
FIGS. 5A and 5B are enlarged fragmentary perspective views of a block body of the plug connector according to the embodiment of the present invention.
Figure 5B:
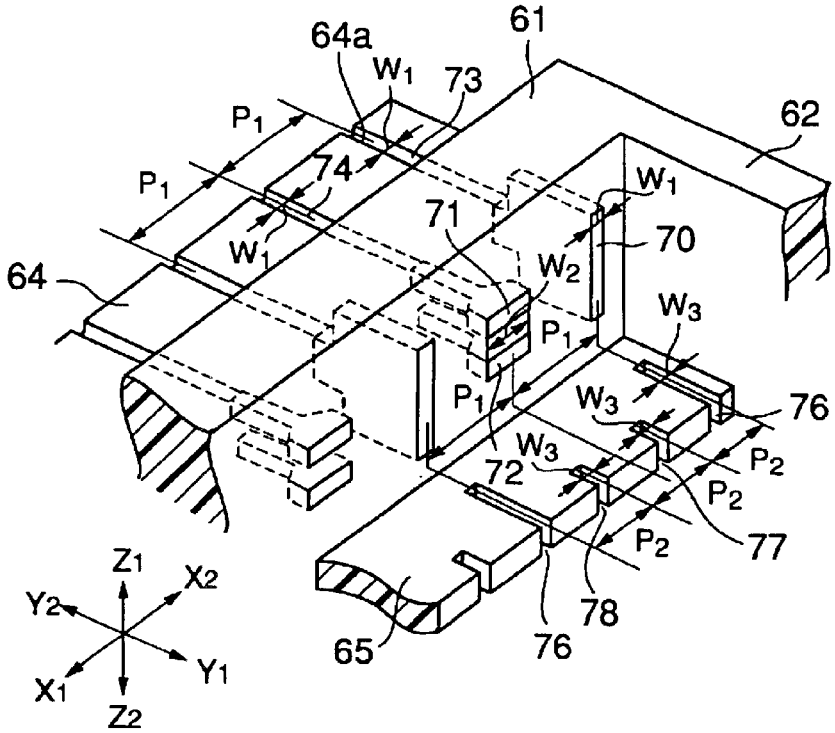

Referring to FIGS. 2 and 3, the block body 60 includes a main body part 61, support parts 62 and 63 extending in the $Y_1$ direction from the $X_2$ and $X_1$ ends, respectively, of the main body part 61, a plate-like projection part 64 projecting in the $Y_2$ direction from the main body part 61, a position control part 65 projecting from the main body part 61 to take up the space between the support parts 62 and 63, and boss parts 66 provided on the lower sides of the support parts 62 and 63. The main body part 61 and the support parts 62 and 63 form a U shape when viewed from the $Z_1$ side. Each of FIGS. 5A and 5B is an enlarged view of part of the block body 60 along the X-axis. Referring to FIGS. 5A and 5B, slits 70 for the ground contact members 90 and tunnels 71 and 72 for the first and second signal contact members 81-1 and 81-2, respectively, are formed alternately to be arranged at the same pitch $P_1$ in the main body part 61. Slits 73, which are the extensions of the slits 70, grooves 74, which are the extensions of the tunnels 71, and grooves 75, which are the extensions of the tunnels 72 are formed in the projection part 64. The grooves 74 and 75 are formed on the $Z_1$- and $Z_2$-side faces, respectively, of the projection part 64. Each slit 73 extends up to a position immediately before the $Y_2$ end of the projection part 64. Parts of the projection part 64 separated by the slits 73 are connected by connection parts 64*a*. Referring to FIG. 3 and 5B, slits 76, 77, and 78 are formed in the $Y_1$ edge of the position control part 65. The deep slits 76 are formed at positions corresponding to the slits 70. The shallow slits 77 and 78 are formed at such positions as to equally divide the distance between each two adjacent slits 76. The slits 76, 77, and 78 are arranged at the same pitch $P_2$, which is two-thirds of the pitch $P_1$.

In the following description, width, thickness, and dimensions a, b, and c are measured along the X-axis.

Referring to FIGS. 5A and 5B, the slits 70, the slits 73, the grooves 74, and the grooves 75 are $W_1$ in width. The $Y_1$-side entrance (opening) of each of the tunnels 71 and 72 is $W_2$ in width. The slits 76, 77, and 78 are $W_3$ in width. The widths $W_1$, $W_2$, and $W_3$ satisfy $W_3<W_1<W_2$.

Referring to FIGS. 3 and 4, each ground contact member 90, which is stamped out from a plate material by a press, includes a plate-like base part 91 having a bulge portion, a rectangular plate-like ground contact part 92 projecting in the $Y_2$ direction from the base part 91, and a mounting terminal part 93 extending in an L-letter shape in the $Y_1$ direction from the $Y_1$–$Z_2$ end (corner) of the base part 91. The mounting terminal part 93 is biased in the $Z_2$ direction by a dimension z relative to the $Y_2$–$Y_1$ center line of the ground contact part 92. A $Y_2$-side half portion 91*a* of the base part 91 and the ground contact part 92 are $t_1$ in thickness. A $Y_1$-side half portion 91*b* of the base part 91 and the mounting terminal part 93 are struck to be thinned by a press so as to be $t_2$ in thickness. Thus, the thinning of the $Y_1$-side half portion 91*b* of the base part 91 and the mounting terminal part 93 is performed easily by press working. The thickness $t_1$ is equal to the width $W_1$ ($t_1=W_1$), and the thickness $t_2$ is equal to the width $W_3$ ($t_2=W_3$). The $Y_1$-side half portion 91*b* includes a $Z_2$-side projection portion 91*b*1 projecting in the $Z_2$ direction. The mounting terminal part 93 extends from the $Z_2$-side projection portion 91*b*1.

Here, the thickness $t_1$ is set to, for instance, 0.4 mm, considering that each of the upper ($Z_1$-side) and lower ($Z_2$-side) ends of the contact part 92 of each ground contact member 90 should have a sufficient width ($X_1$–$X_2$ dimension) and that each ground contact member 90 should have such mechanical strength as to be normally press-fitted into the block body 60 without having buckling. Further, the thickness $t_2$ of each of the $Y_1$-side half portions 91*b* and the mounting terminal part 93 of each ground contact member 90 is set to, for instance, 0.2 mm, satisfying $t_2<t_1$. As a result, a space 100 (FIG. 4) between the mounting terminal parts 93 of the adjacent ground contact members 90 along the X-axis is widened (increased) by 0.4 mm, compared with the case where the above-described thinning of the $Y_1$-side half portion 91*b* and the mounting terminal part 93 is not performed. Consequently, mounting terminal parts 86-1 and 86-2 of the two signal contact members 81-1 and 81-2, respectively, can be placed side by side in the space 100. That is, the mounting terminal parts 86-1 and 86-2 of the two signal contact members 81-1 and 81-2 can be placed side by side between the mounting terminal parts 93 of the adjacent ground contact members 90 while the pitch $P_1$ between the ground contact part 92 of each ground contact member 90 and the signal contact parts 83-1 and 83-2 of the signal contact members 81-1 and 81-2 is being maintained. The $Y_1$-side half portion 91*b* of each base part 91 is thinned equally from both sides of the base part 91.

Referring to FIGS. 3 and 4, each first signal contact member 81-1 includes a base part 82-1 having a bulge portion, a rod-like signal contact part 83-1 projecting in the $Y_2$ direction from the base part 82-1, a length adjustment part 84-1 (FIG. 6B) extending in a direction between the $Y_1$ and $Z_2$ directions, that is, extending obliquely downward, from the base part 82-1, an extension part 85-1 extending in a substantially inversed L-shape from the end of the length adjustment part 84-1, and the mounting terminal part 86-1 extending in the $Y_1$ direction from the end of the extension part 85-1. The base part 82-1 has the dimension a, the signal contact part 83-1 has the dimension b, and each of the mounting terminal part 86-1, the extension part 85-1, and the length adjustment part 84-1 has the dimension c. The dimensions a, b, and c satisfy c<b<a. The dimension bis equal to the thickness $t_1$ and the width $W_1$. The dimension c is equal to the thickness $t_2$ and the width $W_3$. The dimension a is approximately twice the dimension b. Referring to FIG. 4, the center line of the signal contact part 83-1 coincides with the center line of the base part 82-1 in the $Y_1$–$Y_2$ directions or along the Y-axis. The length adjustment part 84-1 extends from the $X_2$ end portion of the base part 82-1. The center line of the length adjustment part 84-1 is offset in the $X_2$ direction by a dimension xrelative to the center line of the base part 82-1. The center line of each of the extension part 85-1 and the mounting terminal part 86-1 following the length adjustment part 84-1 is also offset in the $X_2$ direction by the dimension xrelative to the center line of the base part 82-1.

The second signal contact member 81-2 includes a base part 82-2, a signal contact part 83-2, a length adjustment part 84-2 (FIG. 6C), an extension part 85-2, and the mounting terminal part 86-2. The second signal contact member 81-2 is equal in shape to the first signal contact member 81-1 except that the length adjustment part 84-2 extends obliquely upward from the $X_1$ end portion of the base part 82-2. The dimension xand the pitch $P_2$ satisfy $2 \times x = P_2$. There is no need to bend the length adjustment parts 84-1 and 84-2 in the $X_1$ or $X_2$ direction so that the length adjustment parts 84-1 and 84-2 are easily formed by press working. Further, the extension parts 85-1 and 85-2 and the mounting terminal parts 86-1 and 86-2 are positioned with accuracy.

The ground contact members 90 and the first and second signal contact members 81-1 and 81-2 are press-fitted into the block body 60 from its $Y_1$ side to be incorporated therein.

Figure 6A:
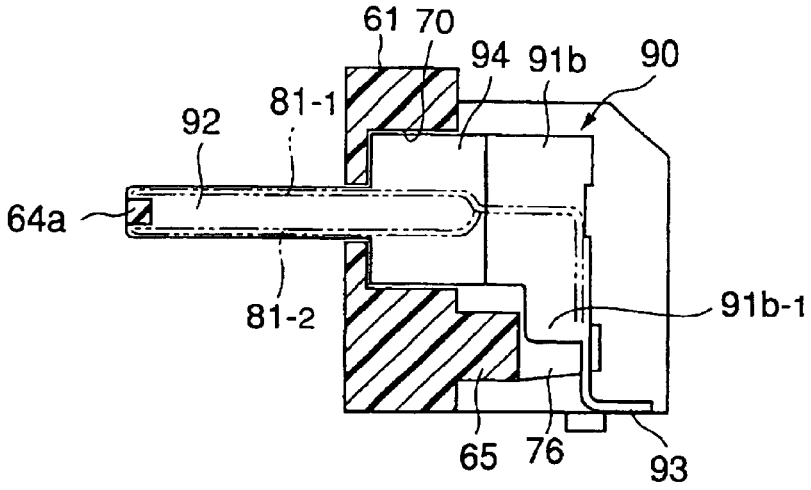
FIGS. 6A through 6C are cross-sectional views of the plug connector of FIG. 2 taken along the lines A—A, B—B, and C—C, respectively, according to the embodiment of the present invention.

Each ground contact member 90 is press-fitted into the corresponding slit 70 its ground contact part 92 first. FIG. 6A is a cross-sectional view of the plug connector 50 of FIG. 2 taken along the line A—A. Referring to FIG. 6A, the base part 91 is positioned inside the slit 70. The ground contact part 92 is positioned inside the slit 73 beyond the slit 70. A $Z_1$-side end face 92*b* and a $Z_2$-side end face 92*c* of the ground contact part 92 are exposed on the $Z_1$-side face and the $Z_2$-side face, respectively, of the projection part 64. A cutout portion 92*a* at the end of the ground contact part 92 is fitted to the connection part 64*a*. The $Y_1$-side half portion 91*b* of the base part 91 including the $Z_2$-side projection portion 91*b*1 projects in the $Y_1$ direction from the main body part 61 of the block body 60. The $Z_2$-side projection portion 91*b*1 and the mounting terminal part 93 are fitted in the slit 76 so that the position of the mounting terminal part 93 is controlled along the X-axis.

Figure 6B:
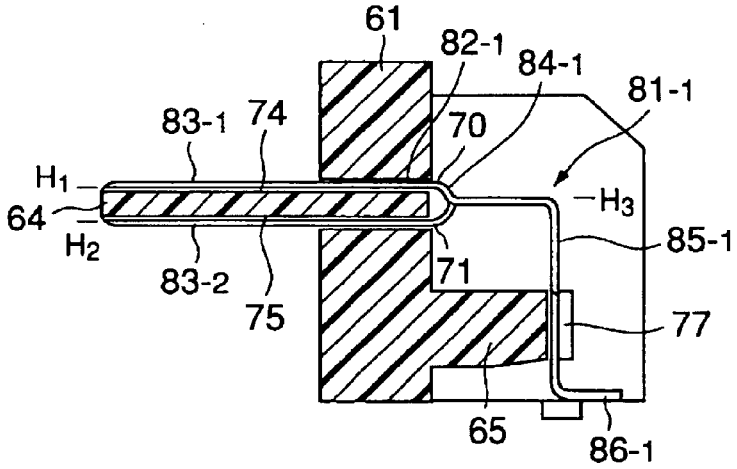

Each first signal contact member 81-1 is press-fitted into the corresponding tunnel 71 its signal contact part 83-1 first. FIG. 6B is a cross-sectional view of the plug connector 50 of FIG. 2 taken along the line B—B. Referring to FIG. 6B, the base part 82-1 is positioned inside the tunnel 71. The signal contact part 83-1 is positioned inside the groove 74 beyond the tunnel 71 to be exposed on the $Z_1$-side face of the projection part 64. The length adjustment part 84-1, the extension part 85-1, and the mounting terminal part 86-1 project in the $Y_1$ direction from the main body part 61 of the block body 60. A portion of the extension part 85-1 close to the mounting terminal part 86-1 is fitted in the slit 77 so that the position of the mounting terminal part 86-1 is controlled along the X-axis.

Figure 6C:
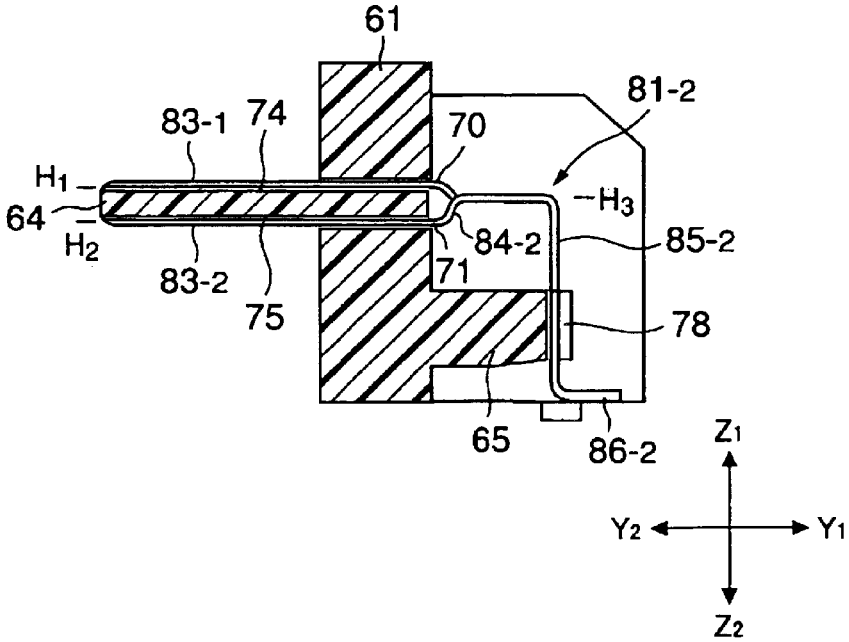

Each second signal contact member 81-2 is press-fitted into the corresponding tunnel 72 its signal contact part 83-2 first. FIG. 6C is a cross-sectional view of the plug connector 50 of FIG. 2 taken along the line C—C. Referring to FIG. 6C, the base part 82-2 is positioned inside the tunnel 72. The signal contact part 83-2 is positioned inside the groove 75 beyond the tunnel 72 to be exposed on the $Z_1$-side face of the projection part 64. The length adjustment part 84-2, the extension part 85-2, and the mounting terminal part 86-2 project in the $Y_1$ direction from the main body part 61 of the block body 60. A portion of the extension part 85-2 close to the mounting terminal part 86-2 is fitted in the slit 78 so that the position of the mounting terminal part 86-2 is controlled along the X-axis.

The ground contact parts 92 and the signal contact parts 83-1 and 83-2 are disposed at the same pitch $P_1$. The mounting terminal parts 93, 86-1, and 86-2 are disposed with accuracy at the same pitch $P_2$, which is two-thirds of the pitch $P_1$. The mounting terminal parts 93, 86-1, and 86-2 are aligned on the X-Y plane defining the bottom face of the block body 60. Although the pitch $P_2$ for the mounting terminal parts 93, 86-1, and 86-2 is narrow, an accident such as a short circuit is prevented from occurring because the deflection of the mounting terminal parts 93, 86-1, and 86-2 in the $X_1$ and $X_2$ directions is controlled by the position control part 65.

The first and second signal contact members 81-1 and 81-2 are provided between the ground contact members 90 adjacent thereto in the $X_1$ and $X_2$ directions, and the first and second signal contact members 81-1 and 81-2, from the signal contact parts 83-1 and 83-2 to the mounting terminal parts 86-1 and 86-2, fall within the projected area of each adjacent ground contact member 90, for instance, the $X_2$-side ground contact member 90 in the case of projecting the $X_2$-side ground contact member 90 from the $X_2$ side. Accordingly, a first pair of the first and second signal contact members 81-1 and 81-2 and a second pair of the first and second signal contact members 81-1 and 81-2 are separated by a corresponding one of the ground contact members 90 so that their mutual interference is controlled. Particularly, the length adjustment parts 84-1 and 84-2 and the extension parts 85-1 and 85-2 of the first and second signal contact members 81-1 and 81-2 of the first pair and the length adjustment parts 84-1 and 84-2 and the extension parts 85-1 and 85-2 of the first and second signal contact members 81-1 and 81-2 of the second pair are separated by the $Y_1$-side half portion 91*b* of the base part 91 of the corresponding one of the ground contact members 90 so that their mutual interference is controlled.

Further, referring to FIGS. 6B and 6C, the height $H_3$ of each of the length adjustment parts 84-1 and 84-2 at its $Y_1$-side end is intermediate between the height $H_1$ of the signal contact part 83-1 and the height $H_2$ of the signal contact part 83-2. Here, the word "height" refers to the distance from the X-Y plane defining the bottom face of the block body 60 along the Z-axis. The length adjustment parts 84-1 and 84-2 adjust the length of the first contact member 81-1 and the length of the second signal contact member 81-2, respectively, so that the length of the first signal contact member 81-1 from the end of the signal contact part 83-1 to the end of the mounting terminal part 86-1 is equal to the length of the second signal contact member 81-2 from the end of the signal contact part 83-2 to the end of the mounting terminal part 86-2. Further, the extension parts 85-1 and 85-2 each extending in an inversed L-letter shape coincide with each other when viewed along the X-axis as shown in FIGS. 6B and 6C, and extend parallel to each other as shown in FIG. 4. Accordingly, while paired "+" and "−" signals are transmitted inside the plug connector 50, or through the extension parts 85-1 and 85-2, the coupling of the "+" and "−" signals continues to be maintained so that no skew occurs.

Referring to FIG. 2, the boss parts 66 of the block body 60 are fitted into holes 106 of a printed circuit board 105 so that the plug connector 50 is positioned thereon. Further, the mounting terminal parts 93, 86-1, and 86-2 are soldered to pads 107 aligned on the printed circuit board 105 so that the plug connector 50 is mounted thereon. A jack connector for differential transmission 110 may be connected to the mounted plug connector 50 with the projection part 64 of the plug connector 50 being fitted into a connection opening 111 of the jack connector 110 in which opening 111 terminals are arranged.

Figure 7:
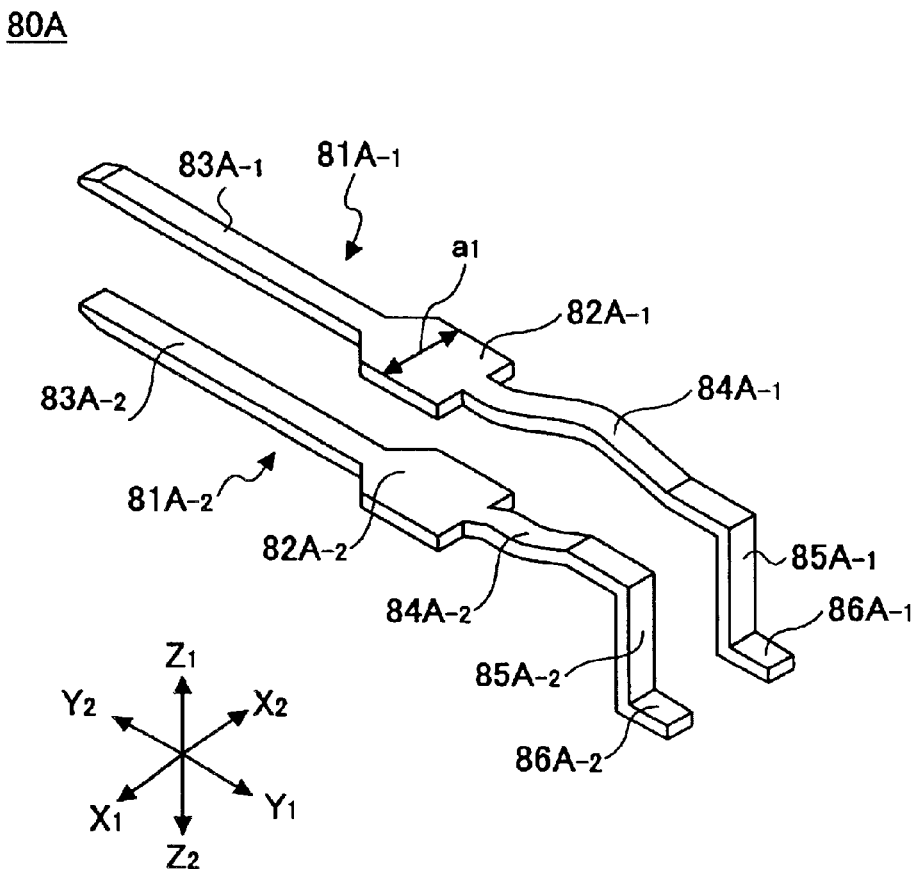
FIG. 7 is a diagram showing a variation of a signal contact pair according to the embodiment of the present invention.

FIG. 7 is a diagram showing a variation of the signal contact pair 80 (that is, a signal contact pair 80A). Referring to FIG. 7, first and second signal contact members 81A-1 and 81A-2 forming the signal contact pair 80A have respective length adjustment parts 84A-1 and 84A-2 extending from the center of a base part 82A-1 and the center of a base part 82A-2, respectively. The length adjustment part 84A-1 is bent obliquely downward and in the X2 direction. The length adjustment part 84A-2 is bent obliquely upward and in the $X_1$ direction. The width $a_1$ of each of the base parts 82A-1 and 82A-2 is smaller than the dimension a of each of the base parts 82-1 and 82-2 of FIG. 3. The first signal contact member 81A-1 has a signal contact part 83A-1 projecting from the base part 82A-1, an extension part 85A-1 extending from the length adjustment part 84A-1, and a mounting terminal part 86A-1 extending from the extension part 85A-1. The second signal contact member 81A-2 has a signal contact part 83A-2 projecting from the base part 82A-2, an extension part 85A-2 extending from the length adjustment part 84A-2, and a mounting terminal part 86A-2 extending from the extension part 85A-2.

The present invention is not limited to the specifically disclosed embodiment, and variations and modifications may be made without departing from the scope of the present invention.

The present application is based on Japanese priority patent application No. 2003-148692, filed on May 27, 2003, the entire contents of which are hereby incorporated by reference.

What is claimed is:

1. A plug connector for differential transmission, comprising:

a block body made of an insulating material, the block body including a main body part and a projection part projecting therefrom;

a plurality of plate-like ground contact members each including a plate-like base part, a ground contact part on a first side of the base part, and a mounting terminal part on a second side of the base part opposite to the first side, the base part and the ground contact part being fixed to the main body part and the projection part, respectively, of the block body;

a plurality of first signal contact members each including a base part, a signal contact part on a first side of the base part, and a mounting terminal part on a second side of the base part opposite to the first side, the base part and the signal contact part being fixed to the main body part and the projection part, respectively, of the block body; and a plurality of second signal contact members each including a base part, a signal contact part on a first side of the base part, and a mounting terminal part on a second side of the base part opposite to the first side, the base part and the signal contact part being fixed to the main body part and the projection part, respectively, of the block body, wherein: the first signal contact members and the corresponding second signal contact members form signal contact pairs;

the signal contact pairs and the ground contact members are arranged alternately, being supported by the block body;

each ground contact member is shaped so that the ground contact member thereof is positioned vertically at a distance from a plane in which the mounting terminal part thereof is disposed, and a portion of the base part thereof on a mounting terminal part side and the mounting terminal part thereof each have a dimension smaller than that of the ground contact part thereof in a direction in which the ground contact members are arranged;

each of the first and second signal contact members is shaped so that a length adjustment part and an extension part are provided between the base part and the mounting terminal part thereof; and the mounting terminal parts of the first and second signal contact members and the mounting terminal parts of the ground contact members are positioned in the same plane so that the mounting terminal parts of the first and second signal contact members of each signal contact pair are disposed between the mounting terminal parts of the ground contact members adjacent to the signal contact pair.

2. The plug connector as claimed in claim 1, wherein the portion of the base part on the mounting terminal part side and the mounting terminal part of each ground contact member are formed by press working.

3. The plug connector as claimed in claim 1, wherein the length adjustment parts and the extension parts of the first and second signal contact members of each signal contact pair are positioned between portions of the base parts of the ground contact members adjacent to the signal contact pair, the portions each projecting from the main body part of the block body in a direction opposite to a direction in which the projection part of the block body projects from the main body part thereof.

4. The plug connector as claimed in claim 1, wherein: the length adjustment parts of the first signal contact members and the length adjustment parts of the second signal contact members are curved in opposite directions so that each length adjustment part is positioned, at an end thereof on an extension part side, at a distance from the plane in which the mounting terminal parts of the first and second signal members are disposed, the distance being intermediate between a distance from the plane at which the signal contact part of each first signal contact member is positioned and a distance from the plane at which the signal contact part of each second signal contact member is positioned; and the extension parts of the first signal contact members and the extension parts of the second signal contact members extend parallel to each other from ends thereof on a length adjustment part side to the mounting terminal parts thereof.

5. The plug connector as claimed in claim 4, wherein: each first signal contact member has the length adjustment part thereof extending from a portion of the base part thereof, the portion being offset from a center of the base part in a first direction; and each second signal contact member has the length adjustment part thereof extending from a portion of the base part thereof, the portion being offset from a center of the base part in a second direction, the second direction being opposite to the first direction along a direction in which the signal contact pairs and the ground contact members are arranged.

6. The plug connector as claimed in claim 4, wherein each first signal contact member has the length adjustment part thereof extending from a center of the base part thereof so as to curve in a first direction; and each second signal contact member has the length adjustment part thereof extending from a center of the base part thereof so as to curve in a second direction, the second direction being opposite to the first direction along a direction in which the signal contact pairs and the ground contact members are arranged.

7. The plug connector as claimed in claim 1, wherein: the block body includes a position control part projecting therefrom in a direction opposite to a direction in which the projection part of the block body projects from the main body part thereof; and the mounting terminal parts of the ground contact members and the first and second signal contact members engage the position control part of the block body so that positions of the mounting terminal parts are controlled.

* * * * *